US010995927B2

(12) United States Patent
Mandl et al.

(10) Patent No.: US 10,995,927 B2
(45) Date of Patent: May 4, 2021

(54) PROJECTION DEVICE FOR A MOTOR VEHICLE HEADLIGHT

(71) Applicant: ZKW GROUP GMBH, Wieselburg (AT)

(72) Inventors: Bernhard Mandl, Ober-Grafendorf (AT); Andreas Moser, Perg (AT); Friedrich Bauer, Bergland (AT); Peter Schadenhofer, Roggendorf (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/769,775

(22) PCT Filed: Nov. 27, 2018

(86) PCT No.: PCT/EP2018/082676

§ 371 (c)(1),
(2) Date: Jun. 4, 2020

(87) PCT Pub. No.: WO2019/110374

PCT Pub. Date: Jun. 13, 2019

(65) Prior Publication Data

US 2020/0300435 A1 Sep. 24, 2020

(30) Foreign Application Priority Data

Dec. 5, 2017 (EP) ..... 17205396

(51) Int. Cl.
*F21S 41/43* (2018.01)
*F21S 41/265* (2018.01)
(Continued)

(52) U.S. Cl.
CPC ..... *F21S 41/43* (2018.01); *F21S 41/143* (2018.01); *F21S 41/153* (2018.01); *F21S 41/265* (2018.01)

(58) Field of Classification Search
CPC ..... F21S 41/43; F21S 41/265; F21S 41/143; F21S 41/153
See application file for complete search history.

(56) References Cited

U.S. PATENT DOCUMENTS 6,769,777 B1 * 8/2004 Dubin ..... F21V 11/186 353/97
2015/0270682 A1 * 9/2015 Daniels ..... F21S 41/16 353/99

(Continued)

FOREIGN PATENT DOCUMENTS

DE 102014019344 A1 6/2016
EP 2085688 A2 8/2009

(Continued)

OTHER PUBLICATIONS

International Search Report of PCT/EP2018/082676 dated Apr. 3, 2019.

(Continued)

*Primary Examiner* — Evan P Dzierzynski
(74) *Attorney, Agent, or Firm* — Eversheds Sutherland (US) LLP

(57) ABSTRACT

The invention relates to a projection device (1) for a motor vehicle headlight, wherein the projection device (1) is designed to project light of at least one light source (2) associated with the projection device (1) into a zone in front of the motor vehicle in at least one light distribution pattern, namely a low-beam light distribution pattern, a total number of the low-beam microlenses comprising at least two groups of low-beam microlenses.

12 Claims, 5 Drawing Sheets

Figure 1:
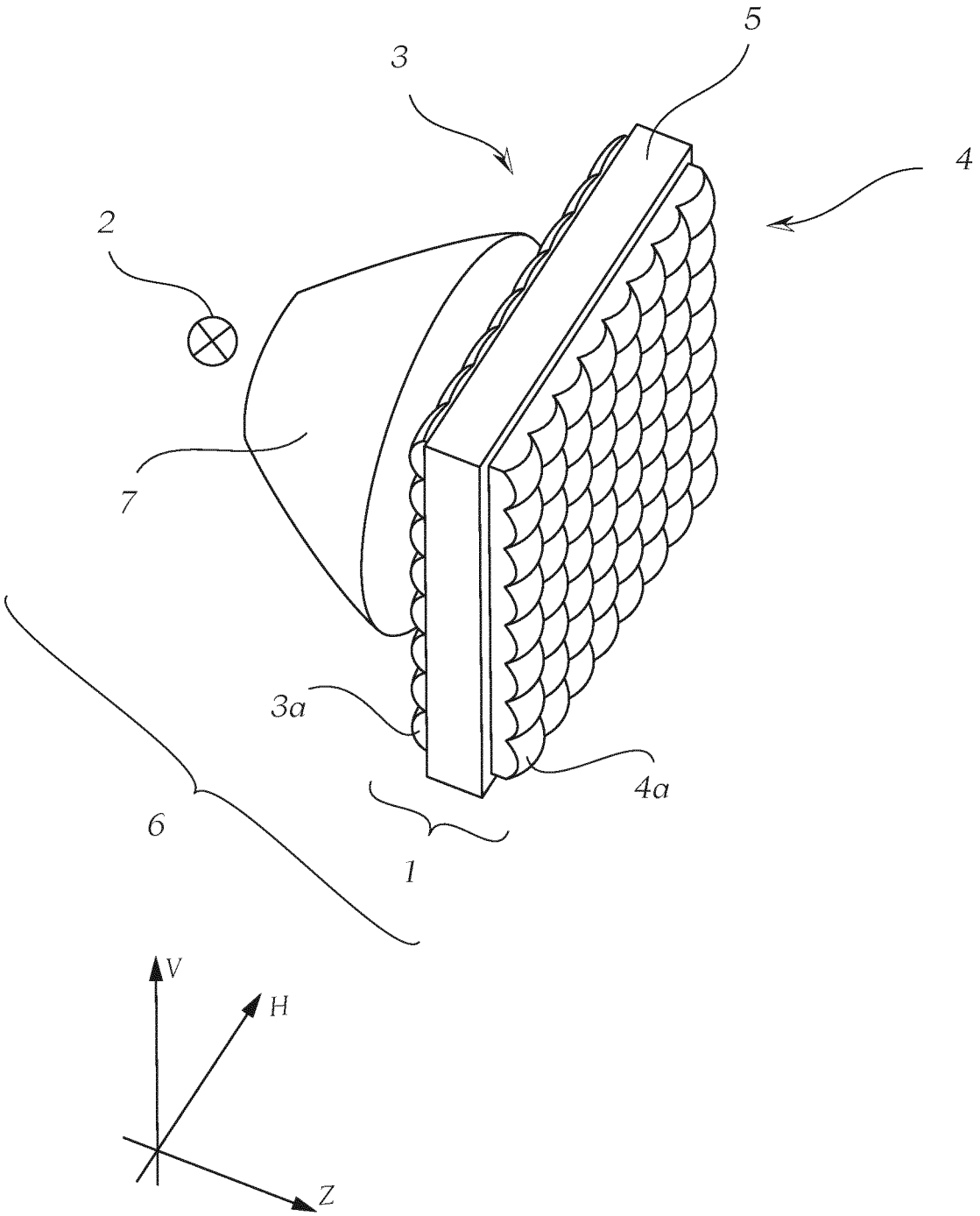

(51) Int. Cl.
*F21S 41/143* (2018.01)
*F21S 41/153* (2018.01)

(56) References Cited

U.S. PATENT DOCUMENTS

| | | | | |
|---|---|---|---|---|
| 2016/0010811 | A1* | 1/2016 | Benitez | F21S 41/153 362/509 |
| 2016/0265733 | A1* | 9/2016 | Bauer | F21S 41/635 |
| 2016/0334074 | A1* | 11/2016 | Fukui | F21S 43/315 |
| 2019/0011102 | A1* | 1/2019 | Gehb | B60Q 1/06 |

FOREIGN PATENT DOCUMENTS

| | | | |
|---|---|---|---|
| JP | 2010108689 | A | 5/2010 |
| KR | 20100069471 | A | 6/2010 |
| WO | 2015058227 | A1 | 4/2015 |
| WO | 2017157624 | A2 | 9/2017 |

OTHER PUBLICATIONS

European Search Report of European Application No. 17 20 5396 dated Jun. 7, 2018.

* cited by examiner

PROJECTION DEVICE FOR A MOTOR VEHICLE HEADLIGHT

The invention relates to a projection device for a motor-vehicle headlamp, wherein the projection device is set up for imaging light of at least one light source assigned to the projection device in a region in front of a motor vehicle in the form of at least one light distribution, namely a dipped-beam distribution, wherein the projection device comprises:

an entrance optical element, which has a total number of micro-entrance optical elements, which are preferably arranged in an array, an exit optical element, which has a total number of micro-exit optical elements, which are preferably arranged in an array, wherein precisely one micro-exit optical element is assigned to each micro-entrance optical element, wherein the micro-entrance optical elements are constructed in such a manner and/or the micro-entrance optical elements and the micro-exit optical elements are arranged in such a manner with respect to one another, that essentially the total light exiting from a micro-entrance optical element only enters into the assigned micro-exit optical element, and wherein the light pre-shaped by the micro-entrance optical elements is imaged by the micro-exit optical elements into a region in front of the motor vehicle as at least one light distribution, wherein each micro-entrance optical element focuses the light passing through it into at least one micro-entrance-optical-element focal point, wherein the micro-entrance-optical-element focal point lies between the micro-entrance optical element and the assigned micro-exit optical element, wherein at least one screen device is arranged between the micro-entrance optical element and the micro-exit optical element, wherein, in each case, a dipped-beam micro-optical element is constructed at least by the micro-entrance optical element, the assigned micro-exit optical element and also the at least one screen device lying therebetween, wherein the at least one screen device is set up for limiting the light distribution imaged by the respective micro-exit optical element in such a manner that the light distribution radiated by the micro-exit optical element forms a portion of the dipped-beam distribution, wherein, for this, the screen device has at least one optically effective screen edge imaging the course of a cut-off line of the dipped-beam distribution.

The invention furthermore relates to a microprojection light module for a motor vehicle headlamp, comprising at least one projection device according to the invention and at least one light source for feeding light into the projection device.

Furthermore, the invention relates to a vehicle headlamp, particularly a motor-vehicle headlamp, comprising at least one microprojection light module according to the invention.

From the prior art, e.g. the document AT 514967 B1 has become known, which shows a projection device of the type mentioned at the beginning. A projection device is shown therein, which has a number of micro-entrance optical elements and micro-exit optical elements, wherein screen devices are arranged between the micro-entrance and exit optical elements. In projection systems, the light distribution is cut off in the focal plane by means of a beam screen, depending on the desired light distribution (particularly in the case of dipped-beam distributions). In this case, in a dipped-beam distribution, the light above the cut-off line is absorbed or reflected in order to prevent the dazzling of oncoming traffic. A small part of the light must however be deflected above the cut-off line in a targeted manner, in order to fulfil the legal requirements on scattered light (signlight). Previously, the scattered-light requirements were usually fulfilled by means of a prism on a lens imaging the light distribution. This proves difficult in microprojection systems owing to the miniaturization down into the submillimetre range and the high tolerance requirements associated with that.

It is an object of the invention to overcome the above-mentioned disadvantages of the prior art. This object is achieved using a projection device of the type mentioned at the beginning, in which, according to the invention, the total number of dipped-beam micro-optical elements comprises at least two groups of dipped-beam micro-optical elements, namely a first group of dipped-beam micro-optical elements having at least one first variant of screen devices, and a second group of dipped-beam micro-optical elements having at least one second variant of screen devices, wherein the configuration of the second variant of screen devices deviates from the configuration of the first variant of screen devices at least in that in the screen device at least one at least partially light-permeable window is formed, inside a light-shading region of the screen device constructed up to the screen edge, for forming a light distribution lying above the cut-off line.

Light can be deflected into the scattering region by means of the light-permeable windows provided according to the invention, which scattering region is provided for example for illuminating traffic signs, wherein the intensity of the illumination in this region can be achieved by choosing a suitable number and configuration of the windows or the screen devices of the second variant.

An optically effective screen edge is understood to mean a screen edge which intervenes in the imaging of the light distribution to limit the same.

The formulation "essentially the total light exiting" means in this case that an attempt is made to irradiate at least the majority of the entire luminous flux, which exits from a micro-entrance optical element, solely into the assigned micro-exit optical element. In particular, one should strive not to irradiate luminous flux into the adjacent micro-exit optical elements, such that as a result, no disadvantageous optical effects result, such as scattered light, which may lead to dazzlement, etc.

In addition, the formulation "wherein the micro-entrance optical elements are constructed in such a manner and/or the micro-entrance optical elements and the micro-exit optical elements are arranged in such a manner with respect to one another" is also to be understood to mean that additional measures, such as for example screens (see below) may be provided, which either exclusively or preferably additionally to their actual function, also have the function that the total luminous flux is directed precisely onto the assigned micro-exit optical element.

Due to the use of a number, plurality or multiplicity of assigned micro-optical elements instead of a single optical element, as in conventional projection systems, both the focal lengths and the dimensions of the micro-optical elements are inherently considerably smaller than in the case of a "conventional" optical element. Likewise, the central thickness can be reduced compared to a conventional optical element. As a result, the construction depth of the projection device may be reduced considerably compared to a conventional optical element.

By increasing the number of micro-optical-element systems, on the one hand, the luminous flux may be increased or scaled, wherein an upper limit with regards to the number of micro-optical-element systems is first limited by the respectively available production methods. For generating a dipped-beam function, e.g. 200 to 400 micro-optical-element systems are sufficient or beneficial, wherein this should neither describe a limiting upper or lower value, but rather merely an exemplary number. To increase the luminous flux, it is beneficial to increase the number of very similar micro-optical elements. Conversely, one may use the multiplicity of micro-optical elements in order to introduce micro-optical elements of different optical behaviour into a projection system, in order to generate or superimpose different light distributions. The multiplicity of micro-optical elements therefore also allows design possibilities, which are not present in a conventional optical element.

One such light module is additionally scalable, i.e. a plurality of structurally identical or similarly built light modules can be assembled to form a larger overall system, e.g. to form a vehicle headlamp.

In a conventional projection system with a projection lens, the lens has a typical diameter of between 60 mm and 90 mm. In a module according to the invention, the individual micro-optical-element systems have typical dimensions of approx. 2 mm×2 mm (in V and H) and a depth (in Z, cf. e.g. FIG. 2) of approx. 6 mm-10 mm, so that in the Z direction, a considerably smaller depth of a module according to the invention results compared to conventional modules.

The light module according to the invention or the projection device may have a small construction depth and are fundamentally freely formable, i.e. it is e.g. possible to configure a first light module for generating a first partial light distribution separately from a second light module for a second partial light distribution and to arrange the same relatively freely, i.e. vertically and/or horizontally and/or offset with respect to one another in terms of depth, so that design specifications can also be realized more easily.

A further advantage of a light module according to the invention or a projection device is that the exact positioning of the light source(s) in relation to the projection device is dispensed with. Exact positioning is less critical insofar as the distance of the illumination unit from the microlens array does not have to be exact. Since the micro-entrance and micro-exit optical elements are already optimally adapted to one another, however, as these virtually form a system, an inexact positioning of the real light source(s) carries less weight. The real light sources are for example approximately punctiform light sources, such as e.g. light-emitting diodes, the light of which is directed in a parallel manner by collimators, such as compound parabolic concentrators (CPCs) or TIR (Total Internal Reflection) lenses.

The projection device or the light module may likewise contain additional micro-optical-element systems, with the aid of which different types of light distributions than a dipped-beam distribution is generated. In this case, "a certain type" of the light distribution is understood to mean a light distribution generated according to relevant standards, for example a light distribution according to standards of UN/ECE regulations in the states of the European Union, particularly regulations 123 and 48 or relevant standards in the other countries or regions.

In the following, the term "carriageway" is only used for simplified representation, as whether the light image is actually on the carriageway or also extends beyond that of course depends on the local conditions. For example, in order to test the radiated light distributions, one generates a projection of the light image onto a vertical surface in accordance with the relevant standards, for example in accordance with the regulation numbers 123 and 48 of the United Nations Economic Commission for Europe (UN/ECE) "Uniform provisions concerning the approval of adaptive front-lighting systems (AFS) for motor vehicles" and "Uniform provisions concerning the approval of vehicles with regard to the installation of lighting and light-signalling devices", the Federal Motor Vehicle Safety Standard FMVSS No. 108 valid for the United States of America, "Lamps, reflective devices, and associated equipment", which is specified in the Code of Federal Regulations CFR under the title 49: Transportation in Chapter V, Part 571 Federal Motor Vehicle Standards in Subpart B as § 571.108, and the National Standard of the People's Republic of China GB/T 30036/2013 "Adaptive Front-Lighting System for Motor Vehicles", which relate to motor vehicle lighting technology.

In particular, it may be beneficial if, in the case of such an illumination device, two or more groups are provided for generating different light distributions, wherein each group forms a different light distribution, which is for example chosen from the following light distributions:

*) cornering light distribution;
*) town light distribution;
*) country light distribution;
*) motorway light distribution;
*) light distribution for booster light for motorway light;
*) cornering-beam light distribution;
*) near field dipped-beam light distribution;
*) light distribution for asymmetric far field dipped beam;
*) light distribution for asymmetric far field dipped beam in cornering-beam mode;
*) main-beam light distribution;
*) anti-glare main-beam light distribution.

Examples of such light distributions can be drawn inter alia from the document AT 514967 B1.

In particular, it may be provided that individual dipped-beam micro-optical elements of the second variant are constructed in such a manner that the light distribution lying above the cut-off line is spaced from the cut-off line with a vertical angle between 0.5° to 2°. Also, the dipped-beam micro-optical elements of the second variant could be constructed in this manner.

Likewise, it may be provided that individual (or all) dipped-beam micro-optical elements of the second variant are constructed in such a manner that the light distribution lying above the cut-off line extends over a horizontal angular range of between 10° and 50° and over a vertical angular range of between 2° and 10°.

Preferably, it may be provided that the at least partially light-permeable window of individual dipped-beam micro-optical elements of the second variant essentially has a rectangular shape. The course of the upper edge of the window may deviate slightly in that the same runs parallel to an optically effective edge of the screen device, that is to say is formed parallel to the cut-off line.

Alternatively, it may be provided that the at least partially light-permeable window of individual dipped-beam micro-optical elements of the second variant is of U-shaped construction.

Also, different configurations of light-permeable windows of individual screen devices can be superposed with one another, so that the light distribution of the sign light is optimized for example homogenized—in a targeted manner.

Thus, it may be provided that the at least light-permeable window of individual dipped-beam micro-optical elements of the second variant is completely light-permeable or only partially light-permeable. Also, the windows of individual dipped-beam micro-optical elements or the associated screen devices may deviate from one another in terms of their shape and/or light permeability. Thus, it may e.g. be provided that individual windows overlap, but deviate from one another in terms of their size. They are therefore responsible for the shading of regions, which photometrically overlap one another.

In addition, it may be provided that the at least one screen device is connected to a support, wherein the support consists of glass. In addition, it may be provided that the entrance optical element and also the exit optical element are securely connected to at least one support of the screen device arranged between the entrance optical element and the exit optical element. As a result, undesired influences—e.g. owing to thermal expansion—can be minimized, and a permanent and exact positioning of the entrance optical element in relation to the exit optical element or vice versa can be ensured. To this end, it may advantageously be provided that the secure connection of the entrance optical element and the exit optical element to the at least one support is formed as a transparent adhesively bonded connection in each case.

The invention furthermore relates to a microprojection light module for a motor vehicle headlamp, comprising at least one projection device according to the invention and at least one light source for feeding light into the projection device. Preferably, an LED light source is assigned to each dipped-beam micro-optical element.

Furthermore, the invention relates to a vehicle headlamp, particularly a motor-vehicle headlamp, comprising at least one microprojection light module according to the invention.

Additionally, the invention relates to a vehicle, a motor vehicle in particular, having at least one vehicle headlamp according to the invention.

Generally, all embodiments of the present invention may also be provided in connection with the generation of near-field light distributions.

Figure 3A:
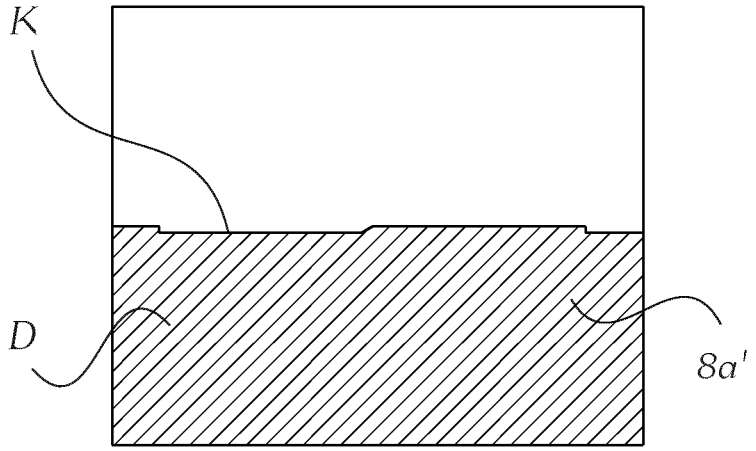
Figure 3B:
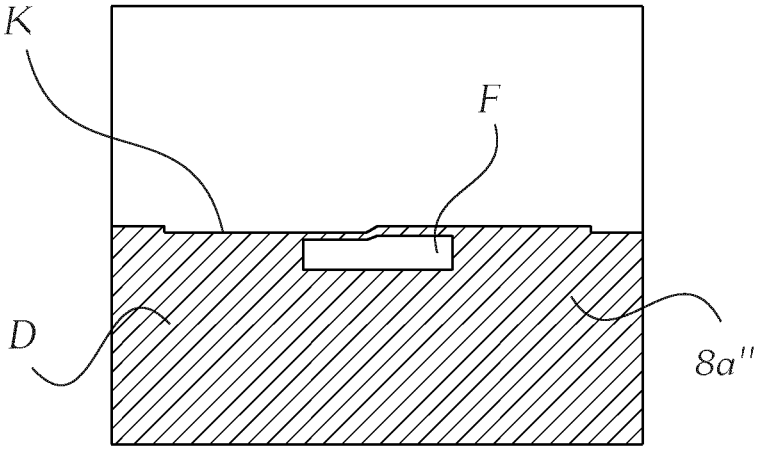
Figure 3C:
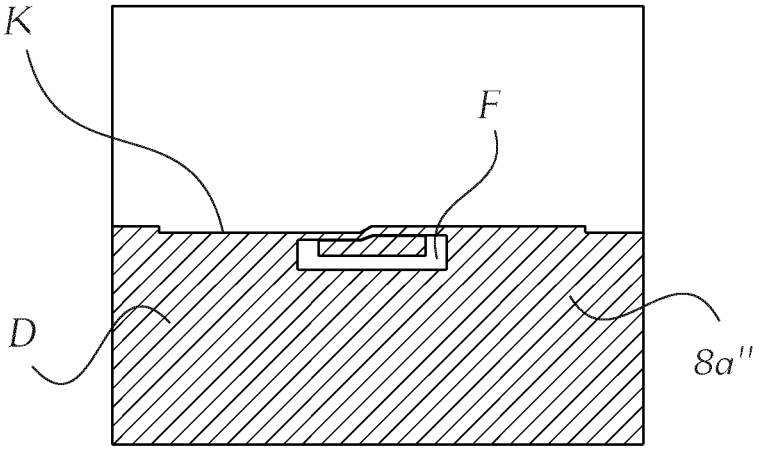
Figure 4A:
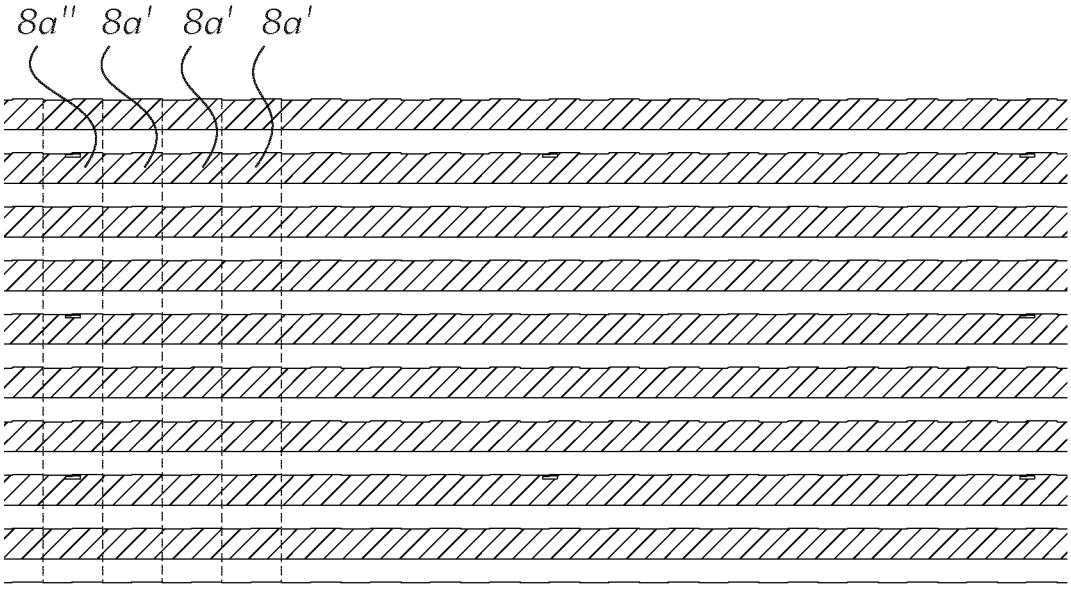
Figure 4B:
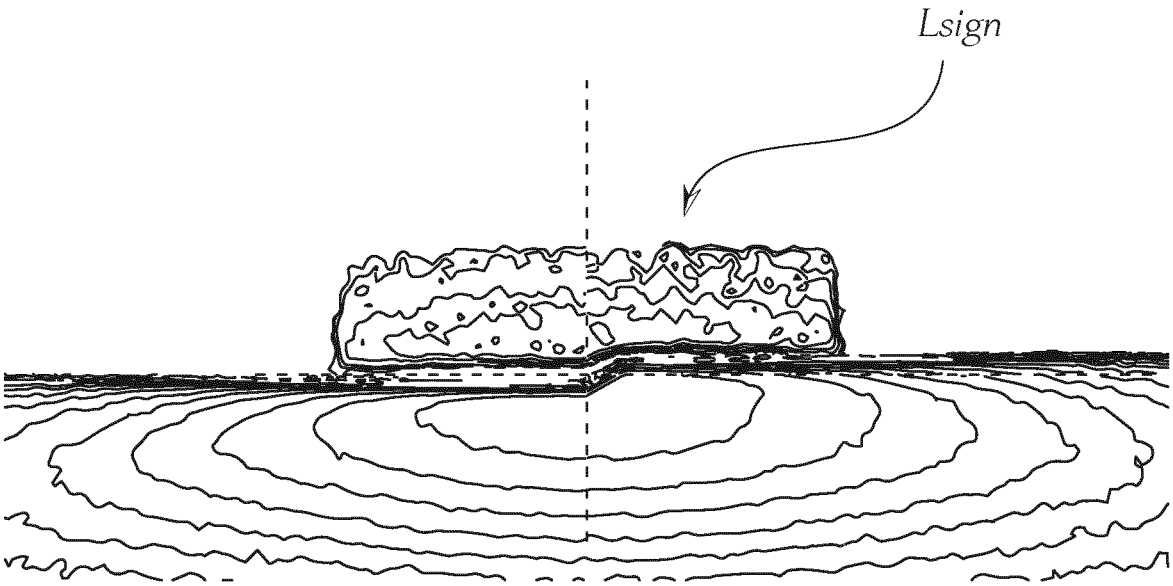
Figure 5A:
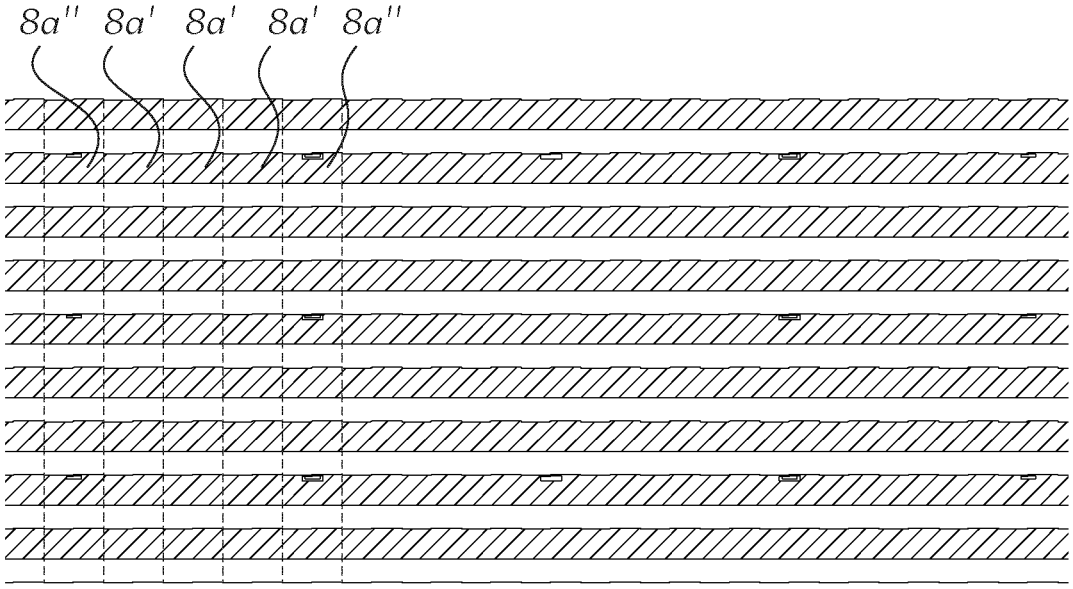
Figure 5B:
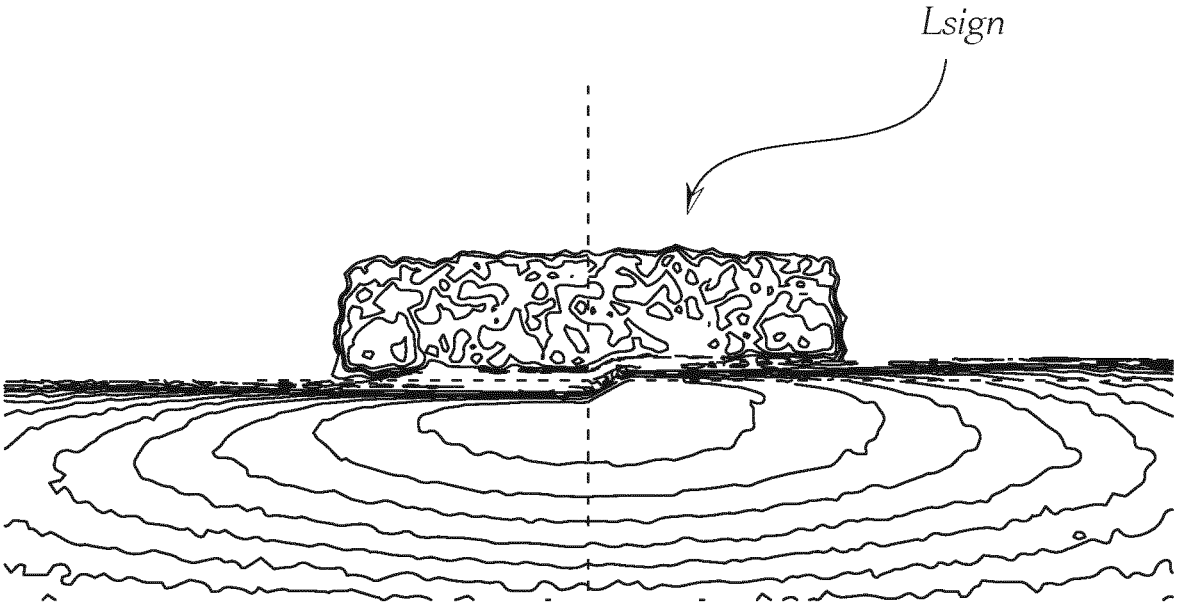

The invention is explained in more detail in the following on the basis of exemplary and non-limiting embodiments, which are shown in the figures. In the figures FIG. 1 shows a schematic illustration of an exemplary projection device, FIGS. 2*a* to 2*d* show a schematic illustration of a method for applying the screen device to a transparent support which can be connected to the micro-entrance optical element and micro-exit optical element, FIGS. 3*a*, 3*b* and 3*c* show different configurations of screen devices, FIG. 4*a* shows a cutout of an arrangement of a plurality of screen devices according to an embodiment of the invention, rowed next to one another, FIG. 4*b* shows a light distribution generated using the arrangement according to FIG. 4*a*, FIG. 5*a* shows a cutout of an arrangement of a plurality of screen devices according to a further embodiment of the invention, rowed next to one another, and FIG. 5*b* shows a light distribution generated using the arrangement according to FIG. 5*a*.

In the following figures—insofar as not otherwise specified—the same reference numbers label the same features.

FIG. 1 shows a schematic illustration of an exemplary projection device 1 in a microprojection light module 6, wherein the projection device 1 may—as discussed in the following—be equipped with an embodiment according to the invention of screen devices. A projection device 1 according to the invention equipped in such a manner is suitable for use in a motor-vehicle headlamp, wherein the projection device 1 is set up for imaging light of at least one light source 2 assigned to the projection device 1 (preferably however, an individually controllable light source, particularly preferably an LED is assigned to each micro-entrance optical element 3*a*), in a region in front of a motor vehicle in the form of at least one light distribution, namely a dipped-beam distribution. The light radiated by the light source 2 may for example be deflected onto an entrance optical element 3 by means of a collimator 7. The projection device 1 comprises the entrance optical element 3, which has a total number of micro-entrance optical elements 3*a*, which are preferably arranged in an array, an exit optical element 4, which has a total number of micro-exit optical elements 4*a*, which are preferably arranged in an array, wherein exactly one micro-exit optical element 4*a* is assigned to each micro-entrance optical element 3*a*.

The micro-entrance optical elements 3*a* are constructed in such a manner and/or the micro-entrance optical elements 3*a* and the micro-exit optical elements 4*a* are arranged in such a manner with respect to one another, that essentially the total light exiting from a micro-entrance optical element 3*a* only enters into the assigned micro-exit optical element 4*a*, and wherein the light pre-shaped by the micro-entrance optical elements 3*a* is imaged by the micro-exit optical elements 4*a* into a region in front of the motor vehicle as at least one light distribution. Each micro-entrance optical element 3*a* is constructed in such a manner that the micro-entrance optical element 3*a* focuses the light passing through it into at least one micro-entrance-optical-element focal point, wherein the micro-entrance-optical-element focal point lies between the micro-entrance optical element 3*a* and the assigned micro-exit optical element 4*a*, wherein at least one screen device 8*a* (cf. FIG. 3) is arranged between the micro-entrance optical element 3*a* and the micro-exit optical element 4*a*, wherein a dipped-beam micro-optical element is constructed in each case at least by the micro-entrance optical element 3*a*, the assigned micro-exit optical element 4*a* and the at least one screen device 8*a* lying therebetween.

The at least one screen device 8*a* is set up for limiting the light distribution imaged by the respective micro-exit optical element 4*a* in such a manner that the light distribution radiated by the micro-exit optical element 4*a* forms a portion of the dipped-beam distribution, wherein, for this, the screen device 8*a* has at least one optically effective screen edge K (see FIGS. 4*a*, 5*a* and 6*a*) imaging the course of a cut-off line of the dipped-beam distribution.

The total number of dipped-beam micro-optical elements comprises at least two groups of dipped-beam micro-optical elements, namely

- a first group of dipped-beam micro-optical elements having at least one first variant of screen devices 8*a*' (cf. FIG. 3*a*), and
- a second group of dipped-beam micro-optical elements having at least one second variant of screen devices 8*a*" (cf. FIG. 3*b* or FIG. 3*c*), wherein the configuration of the second variant of screen devices 8*a*" deviates from the configuration of the first variant of screen devices 8*a*' at least in that in the screen device 8*a*"

at least one at least partially light-permeable window is formed, inside a light-shading region D (cf. FIGS. 3*b* and 3*c*) of the screen device 8*a*" constructed up to the screen edge K, for forming a light distribution Lsign lying above the cut-off line.

Figure 2:
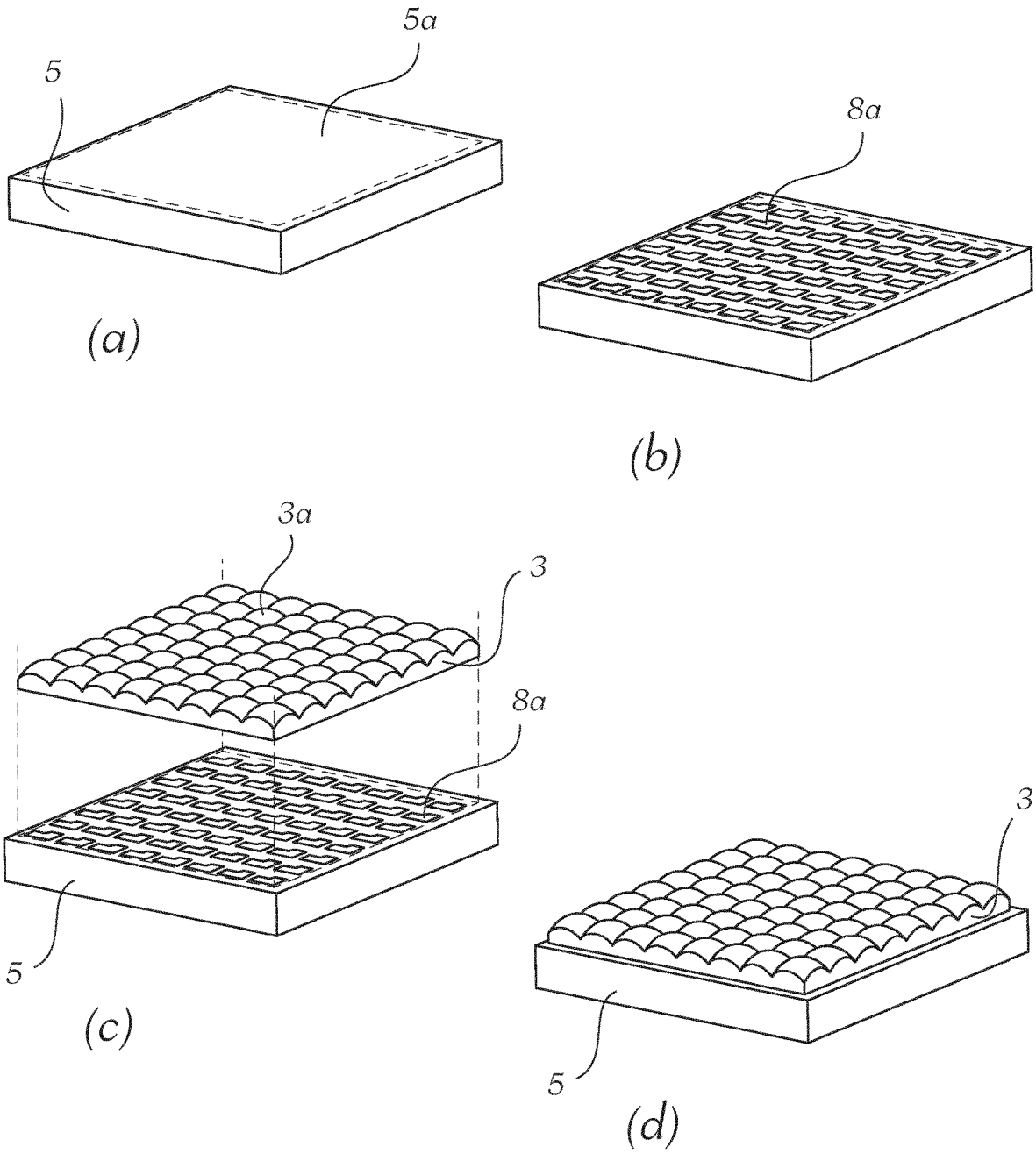

The FIGS. 2 (*a*) to 2 (*d*) show a schematic illustration of individual steps of a method for producing a projection device 1 according to the invention for a motor-vehicle headlamp, wherein the projection device 1 is set up for imaging light of at least one light source 2 assigned to the projection device 1 in a region in front of a motor vehicle in the form of at least one light distribution. FIG. 2 (*a*) shows a support 5 having a first flat side 5*a*, onto which in FIG. 2 (*b*) a first screen device 8*a* is applied, for example by means of screen printing or metal deposition, wherein the support 5 consists at least partially of glass. FIG. 2 (*c*) shows the next step b) of the method, namely the fastening of an entrance optical element 3, which has a number of micro-entrance optical elements 3*a*, which are preferably arranged in an array, on the first flat side 5*a* of the support 5, wherein the entrance optical element 3 at least partially covers the first screen device 8*a* and is arranged in such a manner that light can enter at least partially into the support 5 via the entrance optical element 3 through the first screen device 8*a*, and the fastening of the entrance optical element 3 on the first flat side 5*a* of the support 5 takes place by means of a light-permeable adhesive. FIG. 3 (*d*) shows the state in which the entrance optical element 3 is already securely connected to the support 5. Subsequently, according to step c), the application of a second screen device—for example to avoid scattered light—can take place on a second flat side 5*b* of the support 5 opposite the first flat side 5*a*. Subsequently, the exit optical element 4 can take place on the opposite flat side of the support 5.

FIGS. 3*a*, 3*b* and 3*c* show different configurations of screen devices. FIG. 3*a* relates to a conventional screen device 8*a*', which is termed a screen device 8*a*' of the first variant in this document. FIGS. 3*b* and 3*c* relate to screen devices 8*a*" of the second variant, which have light-permeable windows F in each case, which are provided to deflect light into a region lying above the cut-off line. The fact that these windows are arranged in the screens which are present below the optically effective screen edge K for generating the cut-off line is based on reasoning that the light image in the present embodiment is also rotated by 180° about a horizontal axis in the following beam path.

FIG. 4*a* shows a cutout of an arrangement of a plurality of screen devices 8*a*' and 8*a*" according to an embodiment of the invention, rowed next to one another. By means of a suitable configuration and choice of the number of the screen devices 8*a*" of the second variant, the light distribution to be imaged above the cut-off line can be predetermined in a targeted manner FIG. 4*b* shows a light distribution generated using the arrangement according to FIG. 4*a*, in which the light distribution Lsign present above the cut-off line is clearly discernible. The brightness inside the light distribution is made clear by isolines which clarify the regions of identical illuminance. In the present illustration, the illuminance assumes a maximum just below the cut-off line and decreases outwards. The course of the cut-off line and the additional light distribution Lsign arranged thereabove is clearly discernible in this case.

FIG. 5*a* shows a cutout of an arrangement of a plurality of screen devices 8*a*' and 8*a*" according to a further embodiment of the invention, rowed next to one another, wherein the geometric configuration of individual screen devices 8*a*" of the second variant was varied in a targeted manner therein, so that the brightness is homogenized inside the light distribution Lsign (cf. FIG. 5*b*) generated thereby.

In the projection system according to the invention, several 10s to several 1000s of miniaturized micro-optical elements can be rowed to form an array. This array is illuminated with light which is as parallel as possible (preferably by means of collimators). The individual light distributions are superimposed to form the overall light distribution.

The screen devices 8*a*' and 8*a*" may also be produced e.g. lithographically.

In principle, other contours of the windows F may also be provided. By applying different process steps, a partial modification of the transmittance of the window F is possible, as a result of which, part regions may dependently be realized to be more strongly absorbing or more strongly transmitting. In the above-mentioned example according to FIG. 5*a*, approximately ¾ of the windows F are partially closed. This can likewise be achieved, in that the region to be closed is realized with a transmittance of 25% for all openings. In this manner, signlight can likewise be generated with the aid of a varying transmittance on the positions on the beam screen desired for signlight.

Considering this teaching, the person skilled in the art is able, without inventive effort, to arrive at different embodiments of the invention, which are not shown. The invention is therefore not limited to the embodiments shown. Also, individual aspects of the invention or the embodiments may be picked up and combined with one another. What are important are ideas upon which the invention is based, which may be realized by a person skilled in the art, in knowledge of this description, in myriad ways and be maintained as such in spite of that.

The invention claimed is:

1. A projection device (1) for a motor-vehicle headlamp, wherein the projection device (1) is configured to image light of at least one light source (2) assigned to the projection device (1) in a region in front of a motor vehicle in the form of at least one light distribution comprising a dipped-beam distribution, wherein the projection device (1) comprises:

an entrance optical element (3), which has a number of micro-entrance optical elements (3*a*), which are arranged in an array, an exit optical element (4), which has a number of micro-exit optical elements (4*a*), which are arranged in an array, wherein exactly one micro-exit optical element (4*a*) of the number of micro-exit optical elements (4*a*) is assigned to exactly one micro-entrance optical element (3*a*) of the number of micro-entrance optical elements (3*a*), wherein the micro-entrance optical elements (3*a*) are constructed in such a manner and/or the micro-entrance optical elements (3*a*) and the micro-exit optical elements (4*a*) are arranged in such a manner with respect to one another that essentially all light exiting from a micro-entrance optical element (3*a*) of the number of micro-entrance optical elements (3*a*) only enters into an assigned micro-exit optical element (4*a*) of the number of micro-exit optical elements (4*a*), wherein the light pre-shaped by the micro-entrance optical elements (3*a*) is imaged by the micro-exit optical elements (4*a*) into the region in front of the motor vehicle as the at least one light distribution, wherein each micro-entrance optical element (3*a*) of the number of micro-entrance optical elements (3*a*) is configured to focus light passing through it into at least one micro-entrance-optical-element focal point, wherein the at least one micro-entrance-optical-element focal point lies between the micro-entrance optical element (3*a*) and the assigned micro-exit optical element (4*a*), wherein at least one screen device (8*a*', 8*a*") is arranged between the micro-entrance optical element (3*a*) and the assigned micro-exit optical element (4*a*), wherein a dipped-beam micro-optical element is constructed at least by the micro-entrance optical element (3*a*), the assigned micro-exit optical element (4*a*), and the at least one screen device (8*a*', 8*a*") lying therebetween, wherein the at least one screen device (8*a*', 8*a*") is configured to limit a light distribution imaged by the respective micro-exit optical element (4*a*) in such a manner that the light distribution radiated by the micro-exit optical element (4*a*) forms a portion of the dipped-beam distribution, wherein the at least one screen device (8*a*', 8*a*") has at least one optically effective screen edge (K) imaging a course of a cut-off line of the dipped-beam distribution, wherein a total number of dipped-beam micro-optical elements comprises at least two groups of dipped-beam micro-optical elements, wherein a first group of dipped-beam micro-optical elements comprises at least one first variant of screen devices (8*a*'), wherein a second group of dipped-beam micro-optical elements comprises at least one second variant of screen devices (8*a*"), wherein a configuration of the at least one second variant of screen devices (8*a*") deviates from a configuration of the at least one first variant of screen devices (8*a*') at least in that the at least one second variant screen devices (8*a*") comprise an at least partially light-permeable window (F) formed inside a light-shading region (D) extending up to the at least one optically effective screen edge (K) to form a light distribution (Lsign) lying above the cut-off line.

2. The projection device (1) according to claim 1, wherein individual dipped-beam micro-optical elements of the at least one second variant of screen devices are constructed in such a manner that the light distribution (Lsign) lying above the cut-off line is spaced from the cut-off line with a vertical angle between 0.5° to 2°.

3. The projection device (1) according to claim 1, wherein individual dipped-beam micro-optical elements of the at least one second variant of screen devices are constructed in such a manner that the light distribution (Lsign) lying above the cut-off line extends over a horizontal angular range of between 10° and 50° and over a vertical angular range of between 2° and 10°.

4. The projection device (1) according to claim 1, wherein the at least partially light-permeable window (F) of individual dipped-beam micro-optical elements of the at least one second variant of screen devices essentially has a rectangular shape.

5. The projection device (1) according to claim 1, wherein the at least partially light-permeable window (F) of individual dipped-beam micro-optical elements of the at least one second variant of screen devices is of U-shaped construction.

6. The projection device (1) according to claim 1, wherein the at least light-permeable window (F) of individual dipped-beam micro-optical elements of the at least one second variant of screen devices is completely light-permeable.

7. The projection device (1) according to claim 1, wherein the light-permeable window (F) of individual dipped-beam micro-optical elements of the at least one second variant of screen devices is only partially light-permeable.

8. The projection device (1) according to claim 1, wherein the at least one screen device is connected to a support (5) which comprises glass.

9. The projection device (1) according to claim 1, wherein the entrance optical element (3) and the exit optical element (4) are securely connected to at least one support (5) of the at least one screen device arranged between the entrance optical element (3) and the exit optical element (4).

10. The projection device (1) according to claim 9, wherein a connection of the entrance optical element (3) and the exit optical element (4) to the at least one support (5) is formed as a transparent adhesively bonded connection.

11. A microprojection light module (6) for a motor-vehicle headlamp, comprising at least one projection device (1) according to claim 1 and at least one light source (2) for feeding light into the projection device (1).

12. A motor-vehicle headlamp, comprising at least one microprojection light module (6) according to claim 11.

* * * * *